United States Patent [19]

Harris et al.

[11] Patent Number: 4,626,032

[45] Date of Patent: Dec. 2, 1986

[54] ROCK DITCHER

[76] Inventors: Jesse W. Harris, 815 Afterglow, Apt. 21D, San Antonio, Tex. 78216; Louis L. Lutich, 27039 Ramblewood, San Antonio, Tex. 78261

[21] Appl. No.: 621,781

[22] Filed: Jun. 18, 1984

[51] Int. Cl.[4] ..... F02F 3/08; F02F 5/06

[52] U.S. Cl. ..... 299/36; 299/76; 299/84; 172/93; 172/100; 172/294

[58] Field of Search ..... 299/76, 82, 84, 85, 299/80, 36; 474/110; 37/86; 172/91, 92, 93, 97, 100, 294

[56] References Cited

U.S. PATENT DOCUMENTS

| | | | |
|---|---|---|---|
| 2,684,542 | 7/1954 | Larson et al. | 37/86 |
| 2,749,105 | 6/1956 | Sibley | 299/76 |
| 2,859,544 | 11/1958 | Evans | 37/90 |
| 2,890,033 | 6/1959 | Silks | 299/82 |
| 2,995,843 | 10/1961 | Hutchison | 299/76 |
| 3,028,693 | 4/1962 | Malzahn | 37/86 |
| 3,103,754 | 9/1963 | Wieger | 37/192 R |
| 3,388,487 | 6/1968 | Peck | 37/90 |
| 3,603,010 | 9/1971 | Polinek | 37/83 |
| 3,964,331 | 6/1976 | Oldfield | 474/110 |
| 4,038,763 | 8/1977 | Hutchison | 37/80 R |
| 4,217,001 | 8/1980 | Youngers et al. | 299/82 |

*Primary Examiner*—Stephen J. Novosad
*Assistant Examiner*—Michael Goodwin
*Attorney, Agent, or Firm*—Cox & Smith Inc.

[57] ABSTRACT

Apparatus for excavating hard soils comprising support means, an endless chain capable of movement relative to said support means, drive means for moving said endless chain, means integral with said endless chain operable to contact said hard soils, and means for concentrating the force exerted by said soil contacting means against said hard soils at a specific point along said endless chain while said endless chain is being moved relative to said support means.

26 Claims, 7 Drawing Figures

ROCK DITCHER

BACKGROUND OF THE INVENTION

The present invention relates to an apparatus for the digging of ditches through rocky soils. In particular, the present invention relates to an apparatus for excavating hard soils and rock which operates by concentrating the force exerted by the apparatus against the hard soil at one or more specific points at any given moment so as to increase the ability of the apparatus to excavate the hard soil.

Ditching and excavating machines fall into two basic categories, the "power shovel" type and the "continuous ditcher" type. There are two basic types of continuous ditching and excavating machines, the "rigid wheel" and "chain" types.

The first continuous ditchers were rigid wheel machines, and were developed in very large sizes for use in such applications as the digging of irrigation canals. The more recently developed chain type of ditcher is smaller, more portable, more maneuverable and a more versatile unit. However, both wheel and chain types of ditchers penetrate hard soils poorly and are generally ineffective in massive rock formations. Excavation of massive, hard rock, requires the use of shovels or blasting in conjunction with shovels. Excavation of these harder soils with shovels or blasting has a number of disadvantages, the most serious being that shovel systems require a relatively large area in which to operate and that blasting may harm adjacent structures and is characterized by a great deal of noise and shock waves. There is, therefore, a need for continuous ditchers which are capable of excavating hard formations.

A commonly used type of chain ditcher is characterized by an elongated boom mounted on a supporting structure such as a tractor. The boom is pivoted to the tractor and is provided at both ends with a pair of sprockets, around which a heavy chain passes. The links of the heavy chain are provided with sockets welded to them in an orderly pattern such that when cutting teeth are placed in the sockets, the cutting surfaces of the teeth will cover the entire width of the ditch to be dug at least once in a complete revolution of the chain around the boom. Rotation of the chain as the boom is lowered causes the cutting teeth to abrade and chip away the material in front of the chain until the boom reaches the desired depth and cutting angle. The entire unit is then moved slowly forward so that the ditch is elongated at full depth in the direction taken by the tractor.

As the unit is moved forward, the cutting elements of the chain engage the entire face of ditch; that is, its entire "slant height" times the full width of the ditch. Only the tooth points actually touch the face of the ditch, but all the points on the chain along the entire face of the ditch are being advanced at the rate of the advance of the tractor, therefore, all the points are sharing approximately equal parts of the total effort available to rotate the chain and to advance the chain against the face of the ditch.

When each tooth's share of rotational chain pull and contact pressure is enough to give some pentration into the soil, rock will be chipped and routed from the face of the ditch and the ditching is accomplished at a meaningful rate. Chips and other spoil materials are lifted out of the ditch by the drag and impact forces imparted in an upward direction along the face of the ditch by the rapid rotation of the chain. However, if the rock is of sufficient hardness to resist the penetration of the teeth, the teeth slide along the surface of the rock instead of penetrating into it. The sliding of the teeth along the surface of the rock results in the abrasion of the rock rather than the ripping and cutting necessary for efficient elongation of the ditch. This abrasion generates a large amount of noise and dust and also increases the rate of wear on the cutting teeth.

Some improvement in efficiency has been provided by the redesign of the cutting elements. For instance, a current design utilizes a single point of tungsten carbide mounted on the link of the chain to give a good "claw" angle and to rotate in its socket so as to stay relatively sharp. Although this type of cutting element is less suceptible to the wearing caused by the sliding of the cutting element along the rock surface, the ditching process is still relatively slow, and the cutting elements do eventually wear out.

Another approach has been to use heavyweight units and traction systems capable of slipping the crawler tracks of the tractor upon which the ditching apparatus is mounted. Machines are currently available in the 90 ton class, but they are out of the price range of almost all general contractors, and in spite of their tremendous size and cost, do not represent a significant improvement.

A reduction in the number of cutting elements mounted on the chain links will increase the contact pressure of each of the remaining cutting elements. However, such a reduction concentrates all the wear on the remaining cutting elements, thereby reducing the average "redundancy" so that the loss of one or two cutting elements may require that the unit be shut down so that these cutting elements can be replaced. Further, there is a limit to the number of cutting elements which can be removed before the remaining cutting elements are incapable of excavating the entire surface of the ditch. For instance, approximately 30 cutting elements are required to adequately cover a ditch which is approximately 24 inches wide. In addition, even though each individual cutting element is more productive, the reduced number of cutting elements being employed and the greatly reduced spoil removal effects are disadvantages which effectively cancel the benefits of a reduction in the number of cutting elements.

It is, therefore, an object of the present invention to provide a ditch digging apparatus capable of excavating hard soils which is of similar size, weight, and traction to current ditching machinery. Another object of the present invention is to provide a ditch digging apparatus capable of excavating hard soils with a chain size, form and number of cutting structures which is equivalent to current ditching machinery. Another object of the present invention is to provide a ditch digging apparatus capable of excavating hard soils which is characterized by chain-drive horsepower, speed, and position controls which are similar to existing machinery.

It is another object of the present invention to provide a ditch digging apparatus in which a relatively large proportion of the tractive effort and rotating chain pull of the apparatus is applied to as few as two to four cutting elements at a given instant. It is also an object of the present invention to provide a ditch digging apparatus capable of excavating hard soils with cutting elements which are not worn away as quickly as those of currently available units.

Still another object of the present invention is to provide a boom for a ditch digging apparatus which is capable of excavating hard soils. Another object of the present invention is to provide a boom for a ditch digging apparatus in which the cutting force of the cutting elements of the apparatus is concentrated at one or more specific points along the apparatus at a given moment.

SUMMARY OF THE INVENTION

The objects of the present invention are achieved by providing an apparatus for excavating hard soils comprising an elongate boom pivotally mounted to a traction unit, an endless chain capable of movement relative to the elongate boom and the traction unit, drive means for moving the endless chain, means mounted on the endless chain operable to penetrate the hard soils, and means for concentrating the force exerted by said soil penetrating means at a specific point at a given moment along the endless chain while said endless chain is being moved relative to the boom and the traction unit.

DETAILED DESCRIPTION OF THE PREFERRED EMBODIMENT

Figure 1:
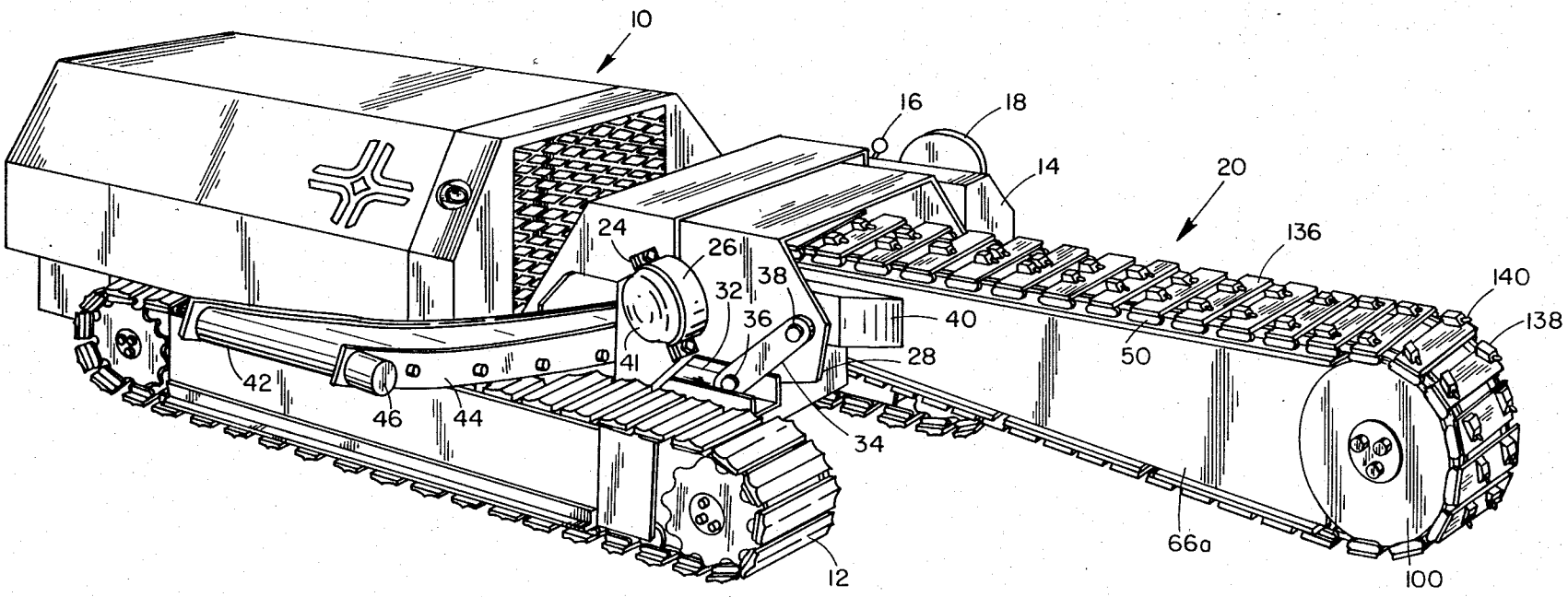
FIG. 1 is an elevated, perspective view of an apparatus constructed in accordance with the present invention.

Referring to FIG. 1, there is shown a traction unit, designated generally at 10. A power source is contained within the traction unit 10. The traction unit 10 is provided with tracks 12 for forward motion of the traction unit 10 under the power provided by the power source. A console 14 is provided with controls 16 so that the operator of the unit can operate the unit from chair 18.

The traction unit 10 is provided with an elongate boom assembly 20 pivotally mounted to the traction unit 10 on shaft 22. Shaft 22 (see FIG. 2) is journaled into the traction unit 10 about flanges 24 and 26 on the traction unit 10 and the hood 28. The boom assembly 20 may be raised or lowered under the influence of hydraulic cylinders (not shown), one end of which is secured to the traction unit 10, the connecting rod 32 of which is pivotally mounted to arm 34 on axle 36. Arm 34 is pivotally mounted to the cross-bar 38, which passes through the hood 28 such that the hood 28 is raised and lowered simultaneously with the changes of elevation in the boom assembly 20. Cross-bar 38 is journaled within the reinforcement box 40, which is integral with the rest of the boom assembly 20, so that extension or retraction of the hydraulic cylinder (not shown) will cause corresponding elevation or lowering of the boom assembly 20.

The traction unit 10 is also provided with hydraulic motor 46 to rotate the endless belt 42 of conveyor 44 to remove the spoil which is pulled up out of the trench being dug. Another hydraulic motor 41 is provided to rotate the endless chain of links 50 around the boom 20.

Figure 2:
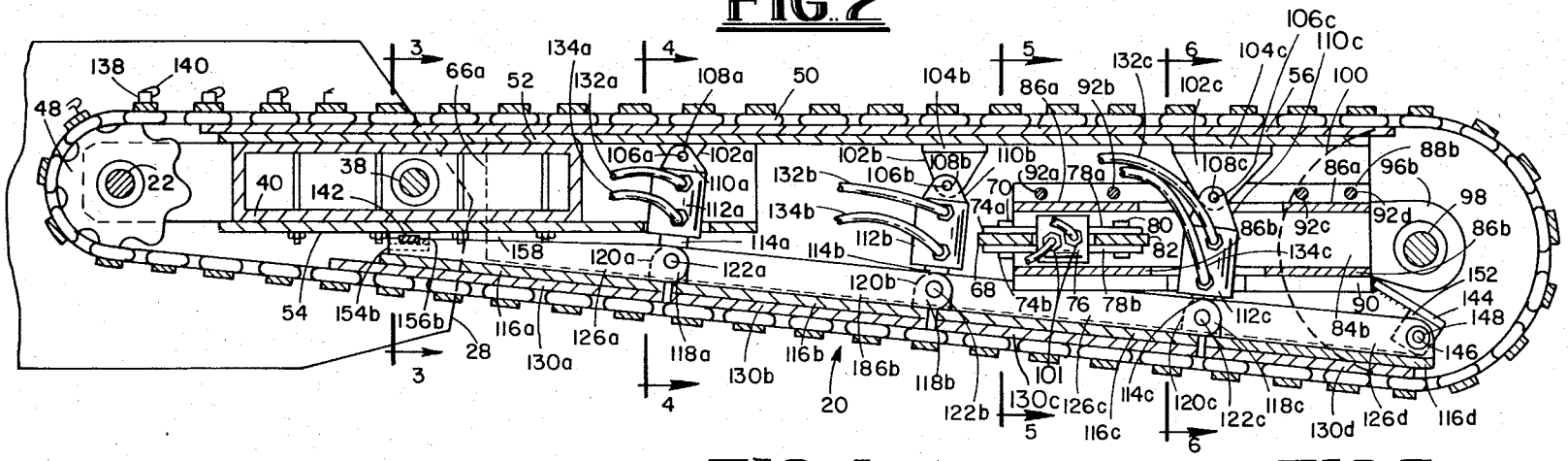
FIG. 2 is a longitudinal cross-section through the elongate boom of the apparatus shown in FIG. 1.
Figure 3:
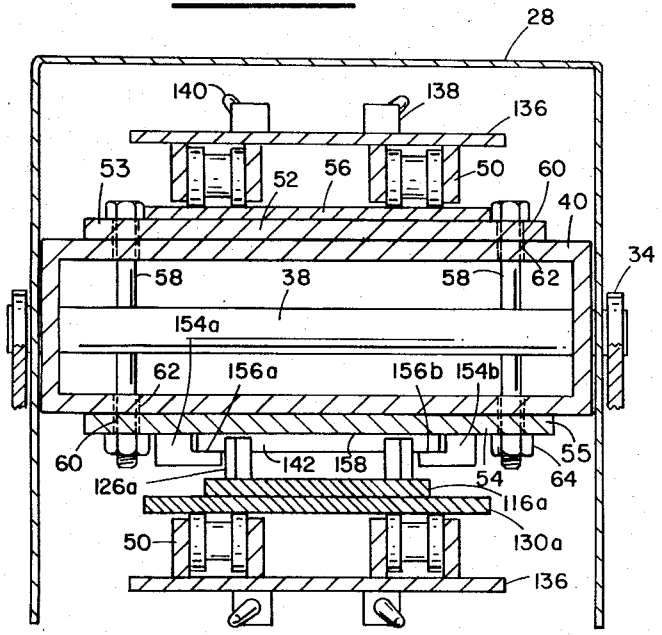
FIG. 3 is a cross-section taken along the lines 3—3 in FIG. 2.

Referring now to FIG. 2, the shaft 22 is journaled in the reinforcement box 40 while also acting as an axle for sprocket 48. Sprocket 48 is driven by the hydraulic motor 41 within the traction unit 10. Stringers 52 and 54 are integral with the reinforcement box 40 and provide the top and bottom of the frame of the boom assembly 20. An elongate wear plate 56 is welded to and extends beyond the top stringer 52. At the end of the boom assembly adjoining the reinforcement box 40, the top stringer 52 and bottom stringer 54 are provided with areas 53 and 55, respectively, which are wider than the width of the stringers 52 and 54. Bolts 58 are threaded through holes 60 in the portion 53 and 55 of the stringers which projects beyond the width of the wear plate 56, through the holes 62 in the reinforcement box 40 and are held in place by the nuts 64 (see FIG. 3). Integral with the top and bottom stringers 52 and 54, and forming the remainder of the frame of the boom assembly 20, are the side plates 66*a* and 66*b*.

Figure 5:
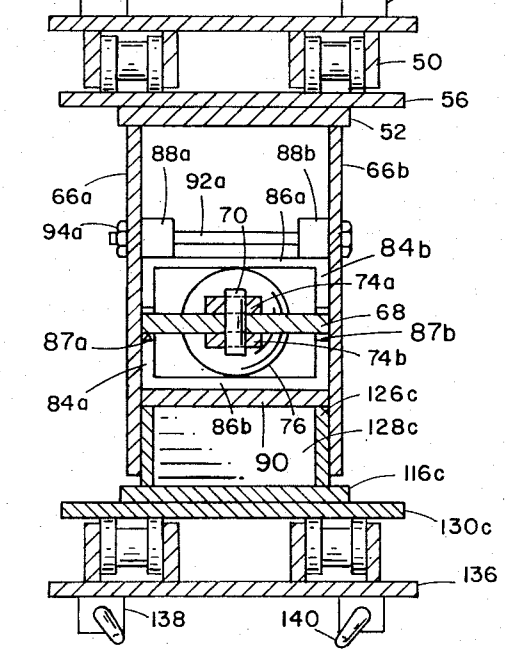
FIG. 5 is a cross-section taken along the lines 5—5 in FIG. 2.
Figure 4:
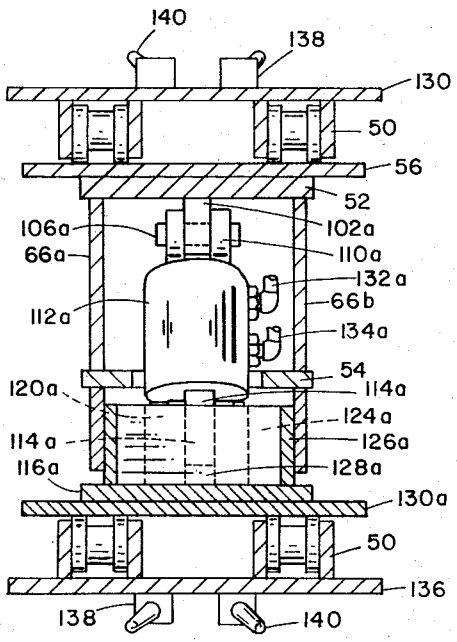
FIG. 4 is a cross-section taken along the lines 4—4 in FIG. 2.
Figure 6:
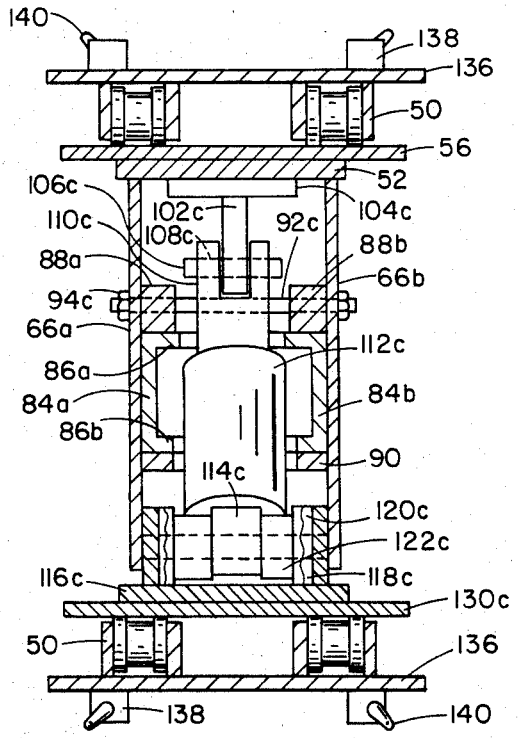
FIG. 6 is a cross-section taken along the lines 6—6 in FIG. 2.

Welded to the side plates 66*a* and 66*b* at the other end of the boom assembly 20 from the reenforcement box 40 is cross bar 68, best shown in FIG. 5. Cross bar 68 is provided with pin 70 which projects through holes in the ears 74*a* and 74*b*. Integral with the ears 74*a* and 74*b* is hydraulic cylinder 76, the connecting rod of which is forked to form two ears 78*a* and 78*b*, best shown on FIG. 2. Connecting rod ears 78*a* and 78*b* are provided with holes through which pin 80 projects. Pin 80 is integral with the cross bar 82, and the ends of cross bar 82 are welded to the side walls 84*a* and 84*b* (FIGS. 5 and 6) of the extendible box formed by the side walls 84*a* and 84*b* and integral top and bottom walls 86*a* and 86*b*. The extendible box formed by the integral side walls 84 and top and bottom walls 86 is movable longitudinally within the boom assembly under the influence of the hydraulic cylinder 76. The extendible box formed by the integral side walls 84 and top and bottom walls 86 is held in place in the frame of the boom assembly by the combined action of the cross bar 68, which is integral with the side plate 66*a* and 66*b*, such that it is contained within the slot 87*a* and 87*b* in the side walls 84*a* and 84*b* of the extendible box and the runners 88*a* and 88*b*, and plate 90, both of which are also integral with the side plates 66*a* and 66*b* of the frame of the boom assembly 20. Additional rigidity is provided by the bolts 92*a*, 92*b*, 92*c* and 92*d* which project through holes in the runners 88*a* and 88*b* and the side plates 66*a* and 66*b*. The bolts 92*a*, 92*b*, 92*c* and 92*d* are held in place by the corresponding nuts 94*a*, 94*b* (not shown), 94*c* and 94*d* (not shown). Journaled in the forward extension 96*a* (not shown) and 96*b* of the side walls 84*a* and 84*b* of the extendible box formed by the integral side walls 84 and top and bottom walls 86 is shaft 98 which serves as an axle for idler 100. The side walls 84*a* and 84*b*, with their forward extensions 96*a* and 96*b* carrying the shaft 98, with the integral idler 100, can be extended or retracted under the influence of the hydraulic cylinder 76.

Integral with top stringer 52 are ears 102*a*, 102*b*, and 102*c*. Ears 102*b* and 102*c* are mounted to base plates 104*b* and 104*c* which are welded to top stringer 52. Ears 102*a*, 102*b* and 102*c* are provided with integral pins 106*a*, 106*b* and 106*c*, respectively, which project through the holes 108*a*, 108*b* and 108*c*, respectively, of hydraulic cylinder mounts 110*a*, 110*b* and 110*c*. Hydraulic cylinder mounts 110*a*, 110*b* and 110*c* are integral with hydraulic cylinders 112*a*, 112*b* and 112*c*, respectively (see FIG. 7). Piston rods 114*a*, 114*b* and 114*c* project downwards from each respective hydraulic cylinder 112*a*, 112*b* and 112*c* and are pivotally mounted to plate members 116*a*, 116*b*, 116*c* and 116*d* at the points at which adjacent plate members are hinged such that the piston rod 114*a* is pivotally mounted to plate members 116*a* and 116*b*, piston rod 114*b* is pivotally mounted to plate members 116*b* and 116*c*, and piston rod 114*c* is pivotally mounted to plate members 116*c* and 116*d*. Hydraulic cylinders 112*a* and 112*c*, with their corresponding piston rods 114*a* and 114*c*, extend through holes in the bottom stringer 54 in the case of the hydraulic cylinder 112*a* and piston rod 114*a* and in the bottom well 86*b* and plate 90 in the case of hydraulic cylinder 112*c* and piston rod 114*c*. The piston rods 114*a*, 114*b* and 114*c* and the overlapping outside tabs 118*a*, 118*b* and 118*c* and inside tabs 120*a*, 120*b* and 120*c* on the plate members 116*a*, 116*b*, 116*c* and 116*d* are pivotally joined by pins 122*a*, 122*b*, and 122*c*. Pairs of spacers 124*a*, 124*b*, and 124*c* are provided between the overlapping outside tabs 118*a*, 118*b* and 118*c* and inside tabs 120*a*, 120*b*, and 120*c*, respectively. Each of the plate members 116*a*, 116*b*, 116*c* and 116*d* is provided with longitudinal stringers 126*a*, 126*b*, 126*c* and 126*d* and cross stringers 128*a*, 128*b*, 128*c* and 128*d* for added rigidity. Welded to the bottom of the plate members 116*a*, 116*b*, 116*c* and 116*d* are wear plates 130*a*, 130*b*, 130*c*, and 130*d*, respectively.

The hydraulic cylinders 112*a*, 112*b*, and 112*c* are extended and retracted under the influence of hydraulic fluid pumped by a pump (not shown) powered by the engine (not shown) of the traction unit 10 through the fluid input lines 132*a*, 132*b* and 132*c* and the fluid output lines 134*a*, 134*b* and 134*c*.

Plate member 116*a* is provided with an integral cross bar 142 (FIG. 7) which is welded to the longitudinal stringers 126*a* of plate member 116*a*. The cross bar 142 is secured to the frame of the boom assembly 20 between L-brackets 154*a* and 154*b* integral with the bottom stringer 54. The distance between the upper surface 156*a* and 156*b* of the L-brackets 143*a* and 154*b*, respectively, and the lower surface 158 of the bottom stringer 54 is slightly greater than the thickness of the cross bar 142, thereby allowing some motion within the space between the upper surface 156 of the L-brackets 154 and the lower surface 158 of the bottom stringer 54 so that the individual plate members 116*a*, 116*b*, 116*c* and 116*d* of the plate assembly can pivot on the pins 122*a*, 122*b* and 122*c*.

Figure 7:
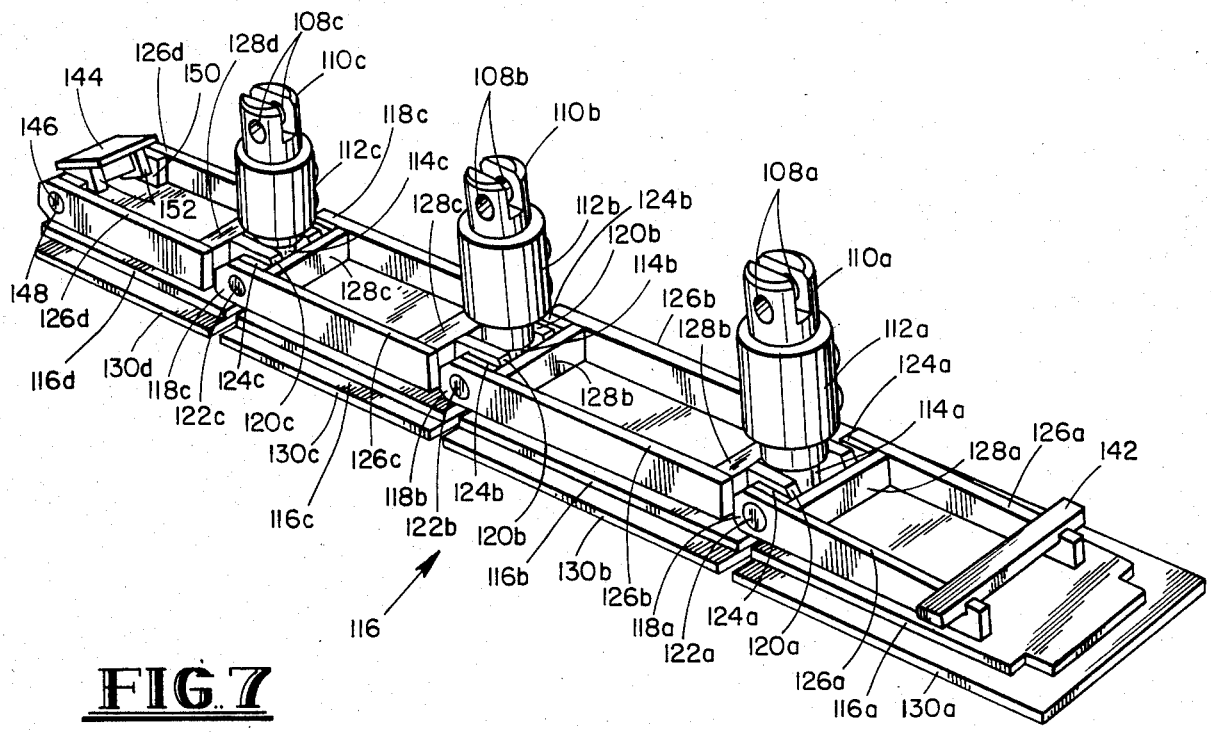
FIG. 7 is an elevated, perspective view of the hydraulic cylinder and wear plate assembly disassembled from the boom shown in FIG. 2.

At the other end of the plate member assembly shown in FIG. 7, plate member 116*d* is provided with a pivoting table 144 mounted on an axle 146 journaled in holes 148 in the longitudinal stringers 126*d* of plate member 116*d*. Spacers 150 are provided to cooperate with the vertical brackets 152, which are integral with the pivoting table 144, to prevent lateral movement of the plate member assembly along the axle 146. The pivoting table 144 is secured between the forward of the side plates 66*a* and 66*b*, and for further rigidity and strength, is also welded to plate 90.

Each link of the endless chain of links 50 is provided with a cross plate 136 upon which an integral socket 138 is mounted with an integral tooth 140. For clarity, only a portion of the endless chain of links 50 is shown with sockets 138 and teeth 140 in FIG. 2. The sockets 138, with the teeth 140 mounted on them, are arranged on the cross members 136 in an orderly pattern along the length of the endless chain of links 80 such that the cutting surfaces will cover the entire width of the proposed ditch at least once in a complete revolution of the endless chain 50 around the boom assembly 20.

Any slack which may be present in the endless chain of links 50 is taken up by loosening bolts 92*a*, 92*b*, 92*c* and 92*d* and then pumping grease into hydraulic cylinder 76 through grease fittings 101 with a separate grease pump, not shown. The additional grease causes the extension of the connecting rod ears 78*a* and 78*b*, and the corresponding extension of the extendible box formed by the integral side walls 84*a* and 84*b* and top and bottom walls 86*a* and 86*b*, carrying the forward extension 96*a* and 96*b*, shaft 98 and idler 100 with it. Bolts 92*a*, 92*b*, 92*c* and 92*d* are then re-tightened, locking the extendible box in place. As the endless chain of links 50 relaxes due to continued use, this extension process is repeated. However, it is an infrequent adjustment.

In operation, the traction unit 10 is driven to the appropriate location for the start of the ditch, and the hydraulic motor 41 is then engaged to begin rotation of the sprocket 48 on shaft 22 to turn the endless chain of links 50. The boom assembly is then lowered by engaging the hydraulic cylinders (not shown) such that the tip of the boom assembly 20 engages the soil surface and begins to rout out the soil. As the tip of the boom assembly 20 penetrates further into the ground and rocky soils are engaged, the hydraulic cylinders 112*a*, 112*b* and 112*c* are energized and reciprocate automatically in cycles such that they move up and down at equal speeds but at different times. If a complete extension-retraction cycle of any one of the cylinders is considered a 360° rotation, the extension of the cylinders is timed 120° apart such that only one of the three hydraulic cylinders is fully extended at any given time. Thus, the wear plates 130*a*, 130*b*, 130*c* and 130*d* are being pushed downward to present an ever-shifting pattern of advance of the boom assembly 20 through the rocky soil and a different cutting angle at any given moment. Because the advance of the wear plates is several times the rate of advance of the traction unit 10 along the ground to be ditched, only a very small area of the endless chain of links 50 will be fully engaged with the rocky soil at any given time. In this manner, the cutting force of the teeth 140 mounted on the cross members 136 of the endless chain of links 50 is concentrated at specific points at specific times, and unloaded at other times, thereby maximizing the cutting force of the teeth 140. Damage to the sprocket 22, idler 100, hydraulic cylinders 112*a*, 112*b* and 112*c*, hydraulic cylinder 76 and the other moving parts inside the boom assembly 20 by stones and spoil is controlled by shielding the moving parts with the side plates 66*a* and 66*b* to exclude gross amounts of these contaminants.

The embodiment discussed is but one means of achieving the desired concentration of the cutting force of the teeth at a given point along the length of the boom assembly. This concentration of force may be accomplished by other embodiments of the invention, the above-described embodiment being only the preferred embodiment. Other such means will occur to those skilled in the art who have the benefit of this disclosure, and all such changes, embodiments and modifications are considered to be a part of the present invention, the scope of which is limited only by the following claims.

What is claimed is:

1. Apparatus for excavating hard soils comprising:
an elongate support means;
an endless chain having a cutting surface capable of movement relative to said support means;
drive means for moving said endless chain;
means for concentrating the cutting force on said cutting surface; and
means spaced along said support means for changing the point of the concentrating force along said cutting surface while said endless chain is being moved relative to said support means.

2. The apparatus of claim 1, wherein said endless chain is comprised of a plurality of links, said soil penetrating means being mounted on said links.

3. The apparatus of claim 1 wherein said support means is comprised of a traction vehicle and an elongate boom.

4. The apparatus of claim 3 wherein said elongate boom is pivotally mounted to said traction vehicle.

5. The apparatus of claim 1 wherein said force concentrating means is comprised of a reciprocating hydraulic cylinder, one end of said hydraulic cylinder being pivotally mounted to said support means, the other end of said hydraulic cylinder bearing against said endless chain.

6. The apparatus of claim 5 wherein said hydraulic cylinder bears against a wear plate interposed between said hydraulic cylinder and said endless chain, said wear plate bearing against said endless chain when the piston of said hydraulic cylinder is extended.

7. Apparatus for digging trenches through hard soils comprising:
an elongate boom;
a traction vehicle upon which the first end of said boom is pivotally mounted;
an endless chain having an upper and lower run along said boom;
the links of said endless chain being provided with means for engaging said soils;
means for pivoting the first end of said boom whereby the second end of said boom may be lowered from the horizontal to engage said soils;
means for rotating said endless chain around said boom along said upper and lower runs; and
means mounted on said boom for selectively moving a portion of the lower run of said endless chain in a direction away from the upper run of said endless chain whereby the advancing force of said traction vehicle is concentrated at said portion of the lower run of said endless chain as said traction vehicle advances.

8. The apparatus of claim 7 wherein said means for urging a portion of the lower run of said endless chain in a direction away from the upper run of said endless chain is comprised of a hydraulically actuated piston.

9. The apparatus of claim 8 wherein said boom is additionally provided with a wear plate pivotally mounted to said piston whereby said piston urges said wear plate against said endless chain, whereby said portion of the lower run of said endless chain is urged in a direction away from the upper run of said endless chain.

10. The apparatus of claim 7 wherein said boom is provided with a plurality of means for urging a portion of the lower run of said endless chain in a direction away from the upper run of said endless chain.

11. The apparatus of claim 7 wherein said means for urging a portion of the lower run of said endless chain in a direction away from the upper run of said endless chain is comprised of a plurality of hydraulically-actuated pistons.

12. The apparatus of claim 11 wherein a wear plate is mounted to each of said pistons whereby said pistons urge one or more of said wear plates against a portion of said endless chain in a direction away from the upper run of said endless chain at a plurality of locations along the lower run of said endless chain.

13. The apparatus of claim 12 wherein said wear plates are hinged to each other.

14. The apparatus of claim 13 wherein said pistons are pivotally mounted to said wear plates at the point at which said wear plates are hinged to each other.

15. The apparatus of claim 14 wherein the number of pistons is equal to the number of hinges between said wear plates.

16. The apparatus of claim 7 wherein said boom is provided with a means for maintaining said endless chain in a taut condition.

17. A boom assembly for a ditch digging apparatus comprising:
an elongate support means;
an endless chain having a cutting surface capable of movement relative to said support means;
means for engaging a drive means to move said endless chain;
means for concentrating the cutting force on the cutting surface; and
means spaced along said support means for changing the point of the concentrating force along the cutting surface during cutting.

18. The apparatus of claim 17 wherein said endless chain is comprised of a plurality of links, said soil penetrating means being mounted on said links.

19. The apparatus of claim 17 wherein said force concentrating means is comprised of the piston of a reciprocating hydraulic cylinder.

20. The apparatus of claim 17 wherein the piston of said hydraulic cylinder is pivotally mounted to at least one wear plate, said wear plate bearing said endless chain when the piston of said hydraulic cylinder is extended.

21. A boom assembly for a ditch digging apparatus comprising:
an elongate support member;
a sprocket journaled in each end of said support member;
an endless chain capable of movement relative to said support member;
means for rotating said endless chain around said sprockets and along an upper and lower run in a plane parallel to said support member;
a plurality of wear plates, the adjacent wear plates being pivotally interconnected with each other such that said wear plates are aligned in a row, said row lying in a plane substantially parallel to the lower run of said endless chain;
the wear plates at each end of said row being pivotally mounted to said support member;
a plurality of hydraulically-actuated pistons, one end of each of said pistons being pivotally mounted to said support member, the other end of each of said pistons being pivotally connected to the pivoting interconnection of two adjacent wear plates whereby extension of said piston urges the edges of adjacent wear plates against the lower run of said endless chain such that said endless chain is forced in a direction away from the plane of the upper run of said endless chain, the number of pistons being equal to the number of pivoting interconnections between wear plates.

22. A method of digging a ditch through hard soil comprising:

contacting said hard soil with an endless moving cutting chain which is mounted on a support means;

advancing said endless cutting chain in the desired direction to the ditch to be dug;

concentrating the cutting force on a portion of the cutting surface of said endless chain with force concentrating means which are spaced along said support means; and changing the point of the concentrating force along said cutting surface during cutting by selectively activating said force concentrating means.

23. The method of claim 22 wherein the advancing force exerted by said soil penetrating means is concentrated at a plurality of points along said endless chain of links.

24. The method of claim 23 wherein the advancing force exerted by said soil penetrating means is concentrated at each of said plurality of points along said endless chain of links at a different time.

25. The method of claim 24 wherein the advancing force exerted by said soil penetrating means is concentrated at each of said plurality of points along said endless chain of links at least once during each complete rotation of said endless chain of links.

26. The method of claim 29 wherein the location along the support means at which the advancing force is exerted is continuously changed.

* * * * *